US007626289B2

(12) United States Patent
Her

(10) Patent No.: US 7,626,289 B2
(45) Date of Patent: Dec. 1, 2009

(54) LINEAR COMPRESSOR

(75) Inventor: Jong Tae Her, Seoul (KR)

(73) Assignee: LG Electronics Inc., Seoul (KR)

( * ) Notice: Subject to any disclaimer, the term of this patent is extended or adjusted under 35 U.S.C. 154(b) by 631 days.

(21) Appl. No.: 11/392,756

(22) Filed: Mar. 30, 2006

(65) Prior Publication Data

US 2006/0250032 A1 Nov. 9, 2006

(30) Foreign Application Priority Data

May 6, 2005 (KR) ..... 10-2005-0037961

(51) Int. Cl.
*H02K 41/00* (2006.01)

(52) U.S. Cl. ..... 310/12; 310/15; 417/417

(58) Field of Classification Search ..... 310/12–15; 417/417

See application file for complete search history.

(56) References Cited

U.S. PATENT DOCUMENTS

| | | | | |
|---|---|---|---|---|
| 1,996,160 | A * | 4/1935 | Konig | 417/416 |
| 5,525,845 | A * | 6/1996 | Beale et al. | 310/30 |
| 5,772,410 | A | 6/1998 | Chang | |
| 6,250,895 | B1 | 6/2001 | Kawahara et al. | |
| 6,506,032 | B2 | 1/2003 | Kawahara et al. | |
| 6,809,434 | B1 * | 10/2004 | Duncan et al. | 310/12 |
| 6,835,052 | B2 | 12/2004 | Kim | |
| 6,914,353 | B2 | 7/2005 | Hong et al. | |
| 7,213,405 | B2 * | 5/2007 | Shapiro | 62/228.3 |
| 2001/0043870 | A1 | 11/2001 | Song | |
| 2003/0147759 | A1 | 8/2003 | Chang | |
| 2004/0042914 | A1 | 3/2004 | Kim et al. | |
| 2004/0071568 | A1 | 4/2004 | Hyeon | |
| 2004/0239192 | A1 | 12/2004 | Lilie | |
| 2004/0247457 | A1 | 12/2004 | Kim et al. | |
| 2004/0247466 | A1 | 12/2004 | Lee et al. | |
| 2005/0260083 | A1 | 11/2005 | Park | |
| 2006/0091735 | A1 * | 5/2006 | Song et al. | 310/12 |

FOREIGN PATENT DOCUMENTS

| | | |
|---|---|---|
| CN | 1514909 | 7/2004 |
| CN | 1573097 | 2/2005 |
| EP | 0979943 | 2/2000 |
| KR | 2002-0073840 | 9/2002 |
| KR | 2004-0101732 | 12/2004 |

OTHER PUBLICATIONS

U.S. Appl. No. 10/331,761 to Won-Sik Oh, filed on Dec. 31, 2002.
English Language Abstract of KR 2004-0101732.
English Language Abstract of KR 2002-0073840.
English language Abstract of CN 1514909.
English language Abstract of CN 1573097.

* cited by examiner

*Primary Examiner*—Dang D Le
(74) *Attorney, Agent, or Firm*—Birch, Stewart, Kolasch & Birch, LLP

(57) ABSTRACT

A linear compressor in which an inner core is integrally mounted with a magnet to linearly reciprocate simultaneously and is also mounted on a core frame that comes into close contact with an outer circumference of a cylinder. With this configuration, the core frame is able to stably support the weight of the inner core, resulting in improved rigidity and reliability of the compressor.

20 Claims, 4 Drawing Sheets

LINEAR COMPRESSOR

CROSS-REFERENCE TO RELATED APPLICATIONS

The present disclosure relates to subject matter contained in priority Korean Application No. 2005-37961, filed on May 6, 2005, which is herein expressly incorporated by reference in its entirety.

BACKGROUND OF THE INVENTION

1. Field of the Invention

The present invention relates to a linear compressor, and, more particularly, to a linear compressor in which an inner core is integrally mounted with a magnet to linearly reciprocate simultaneously and is also mounted on a core frame that comes into close contact with an outer circumference of a cylinder, resulting in improved rigidity and reliability of the compressor.

2. Description of the Related Art

Generally, a linear compressor is an apparatus to suction and compress fluid, such as refrigerant gas (hereinafter referred to as "fluid"), while linearly reciprocating a piston inside a cylinder using a linear driving force of a linear motor to thereby discharge the compressed fluid.

FIG. 1 is a longitudinal sectional view of a conventional linear compressor.

As shown in FIG. 1, the conventional linear compressor includes a shell 4 having a fluid suction pipe 2, a linear compression unit 6 mounted in the shell 4 to compress fluid, and a loop pipe 8 used to discharge the compressed fluid from the linear compression unit 6 to the outside of the shell 4.

The linear compression unit 6 includes a cylinder block 12 centrally provided with a cylinder 10, a rear cover 16 having a fluid suction port 14, a piston 18 inserted in the cylinder 10 to linearly reciprocate inside the cylinder 10, a linear motor 20 adapted to generate a driving force for linearly reciprocating the piston 18 inside the cylinder 10, and a discharge valve assembly 30 mounted at a front side of the cylinder 10 to discharge the compressed fluid from the cylinder 10.

The linear motor is generally divided into a stator and a mover.

The stator includes an outer core 21, an inner core 22 spaced apart from the outer core 21 to define a gap therebetween, a bobbin 23 mounted in the outer core 21, and a coil 24 wound around the bobbin 23 to produce a magnetic field.

The mover includes a magnet 25 interposed between the outer core 21 and the inner core 22 to define gaps with both the outer core 21 and the inner core 22, and a magnet frame 26 to support the magnet 25 affixed thereto.

The piston 18 has a flange portion 28 configured to be affixed to the magnet frame 26. Through the magnet frame 26 and flange portion 28, thereby, a linear movement force of the magnet 25 is transmitted to the piston 18.

Specifically, the magnet 25 is affixed to an outer circumference of the magnet frame 26, and the flange portion 28 of the piston 18 is affixed to an inner end surface of the magnet frame 26.

Now, the operation of the conventional linear compressor configured as stated above will be explained.

Upon driving of the linear motor 20, first, the magnet 25 linearly reciprocates using a magnetic force produced around the coil 24. As the linear reciprocating movement of the magnet 25 is transmitted to the piston 18 via the magnet frame 26, thereby, the piston 18 linearly reciprocates inside the cylinder 10.

According to the linear reciprocating movement of the piston 18, fluid inside the shell 4 is introduced into the cylinder 10 via the fluid suction port 14 of the rear cover 16. After being compressed inside the cylinder 10 by means of the piston 18, the compressed fluid is discharged to the outside of the shell 4 via the discharge valve assembly 30 and the loop pipe 8.

However, the conventional linear compressor is problematic because predetermined gaps must be accurately defined at opposite sides of the magnet 25, that is, between the magnet 25 and the outer core 21 and between the magnet 25 and the inner core 22. This requires a strict tolerance control of the magnet frame 26.

SUMMARY OF THE INVENTION

The present invention is provided in view of the above drawbacks, and it is an object of the present invention to provide a linear compressor which can achieve easy tolerance control of parts and improved rigidity and reliability.

In accordance with a first aspect of the present invention, the above and other objects can be accomplished by the provision of a linear compressor including: an outer core; an inner core spaced apart from the outer core to define a gap therebetween; a magnet mounted in an outer circumference of the inner core; a core frame to support the inner core mounted thereon; a cylinder provided to come into close contact at an outer circumference thereof with an inner circumference of the core frame; a piston provided to reciprocate inside the cylinder; and a connecting member to connect the piston to the core frame.

Preferably, the connecting member may be a connecting rod to connect the piston to the core frame.

Preferably, opposite ends of the connecting rod may be rotatably coupled to the piston and the core frame, respectively.

Preferably, the opposite ends of the connecting rod may be coupled to the piston and the core frame, respectively, by universal joints.

Preferably, the opposite ends of the connecting rod may be hingedly coupled to the piston and the core frame, respectively, by hinge pins.

Preferably, the core frame may have a cylindrical shape having an open front surface and may be slidably provided on the outer circumference of the cylinder.

Preferably, a plurality of fluid suction ports may be formed at a rear surface of the core frame.

Preferably, a spring support may be coupled to the core frame to cooperate with the core frame, and a plurality of main springs may be mounted to the spring support to provide an elastic force during a sliding movement of the core frame.

Preferably, an interior space of the cylinder may be divided into a fluid suction channel and a compression chamber by the piston, and the piston may be formed with suction ports to guide fluid, introduced via the suction channel, into the compression chamber.

In accordance with a first aspect of the present invention, the above and other objects can be accomplished by the provision of a linear compressor including: an outer core; an inner core spaced apart from the outer core to define a gap therebetween; a magnet mounted in an outer circumference of the inner core; a core frame to support the inner core mounted thereon; a cylinder provided to come into close contact at an outer circumference thereof with an inner circumference of the core frame; and a piston disposed to reciprocate inside the cylinder and connected to the core frame.

According to the linear compressor of the present invention, the inner core is integrally mounted with the magnet to linearly reciprocate simultaneously and is also mounted on the core frame that comes into close contact with the outer circumference of the cylinder. This configuration provides the core frame with a sufficient force to support the inner core, resulting in improved rigidity and reliability of the compressor.

Further, according to the present invention, since the core frame is connected to the piston by interposing the connecting rod, and the opposite ends of the connecting rod are hingedly coupled to both the core frame and the piston, it is possible to prevent a force generated from a linear motor from being directly transmitted to the piston, thereby eliminating the risk of abrasion of the piston and cylinder.

BRIEF DESCRIPTION OF THE DRAWINGS

The above and other objects, features and other advantages of the present invention will be more clearly understood from the following detailed description of the preferred embodiments, given as nonlimiting examples, with reference to the accompanying drawings, in which.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice Now, preferred embodiments of the present invention will be described with reference to the accompanying drawings.

Figure 1:
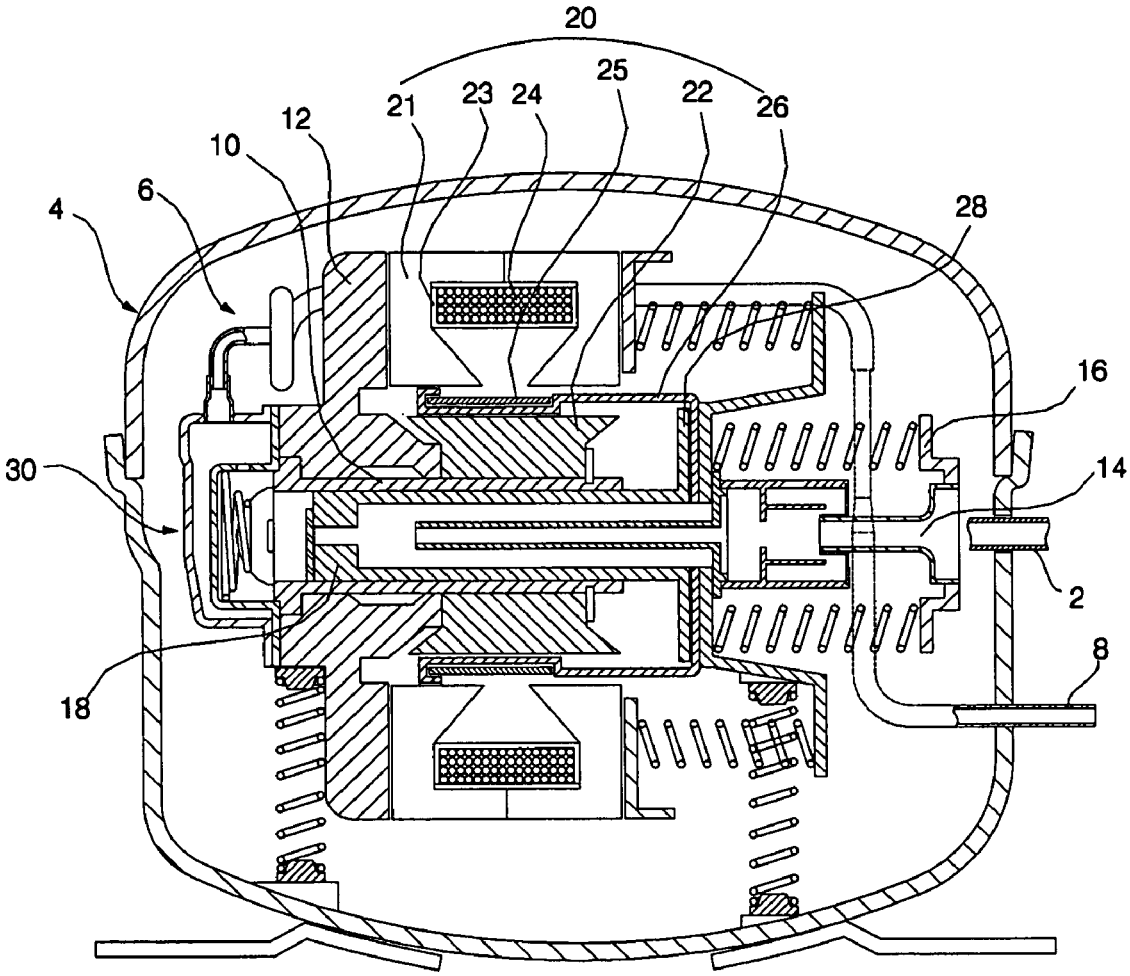
FIG. 1 (Prior Art)
FIG. 1 is a longitudinal cross-sectional view of a conventional linear compressor.
Figure 2:
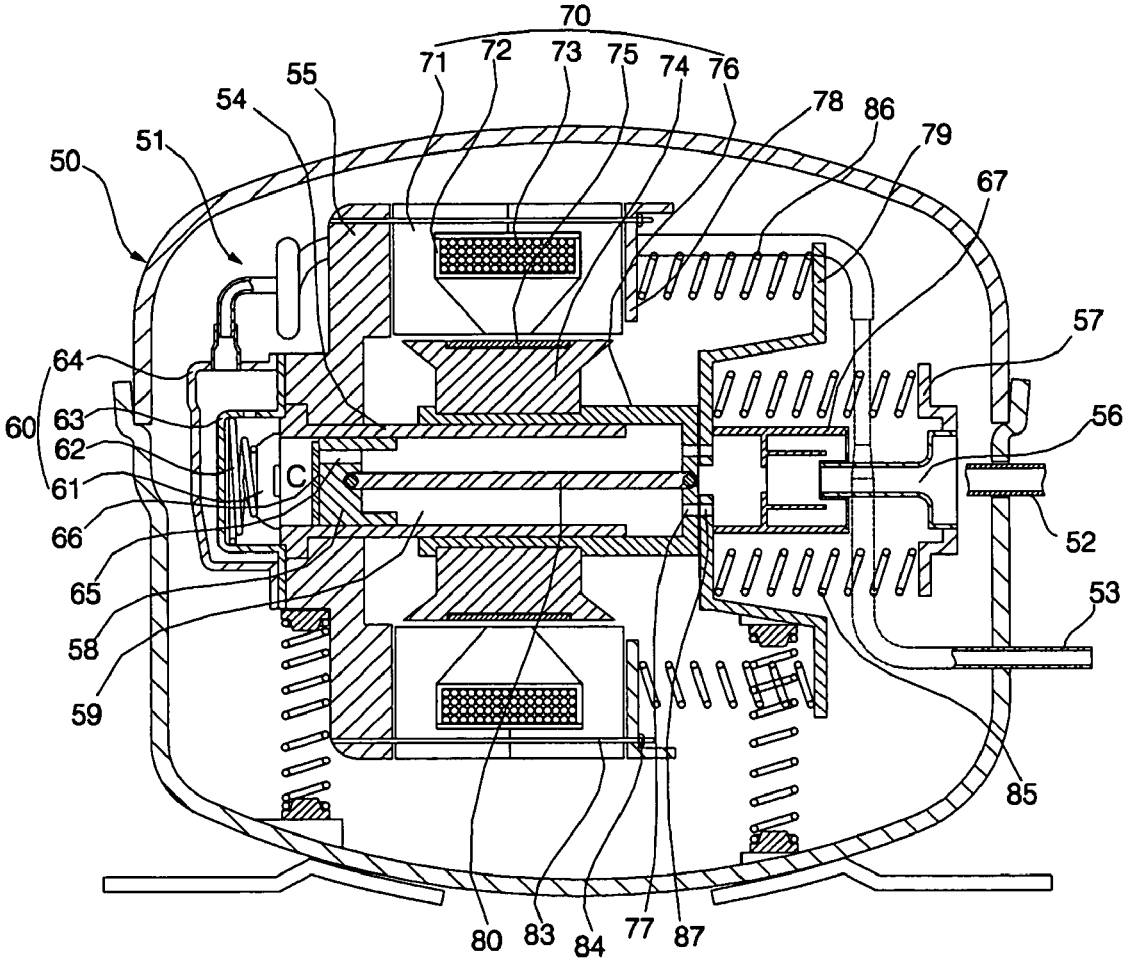
FIG. 2 is a longitudinal cross-sectional view of a linear compressor according to a first embodiment of the present invention.
Figure 3:
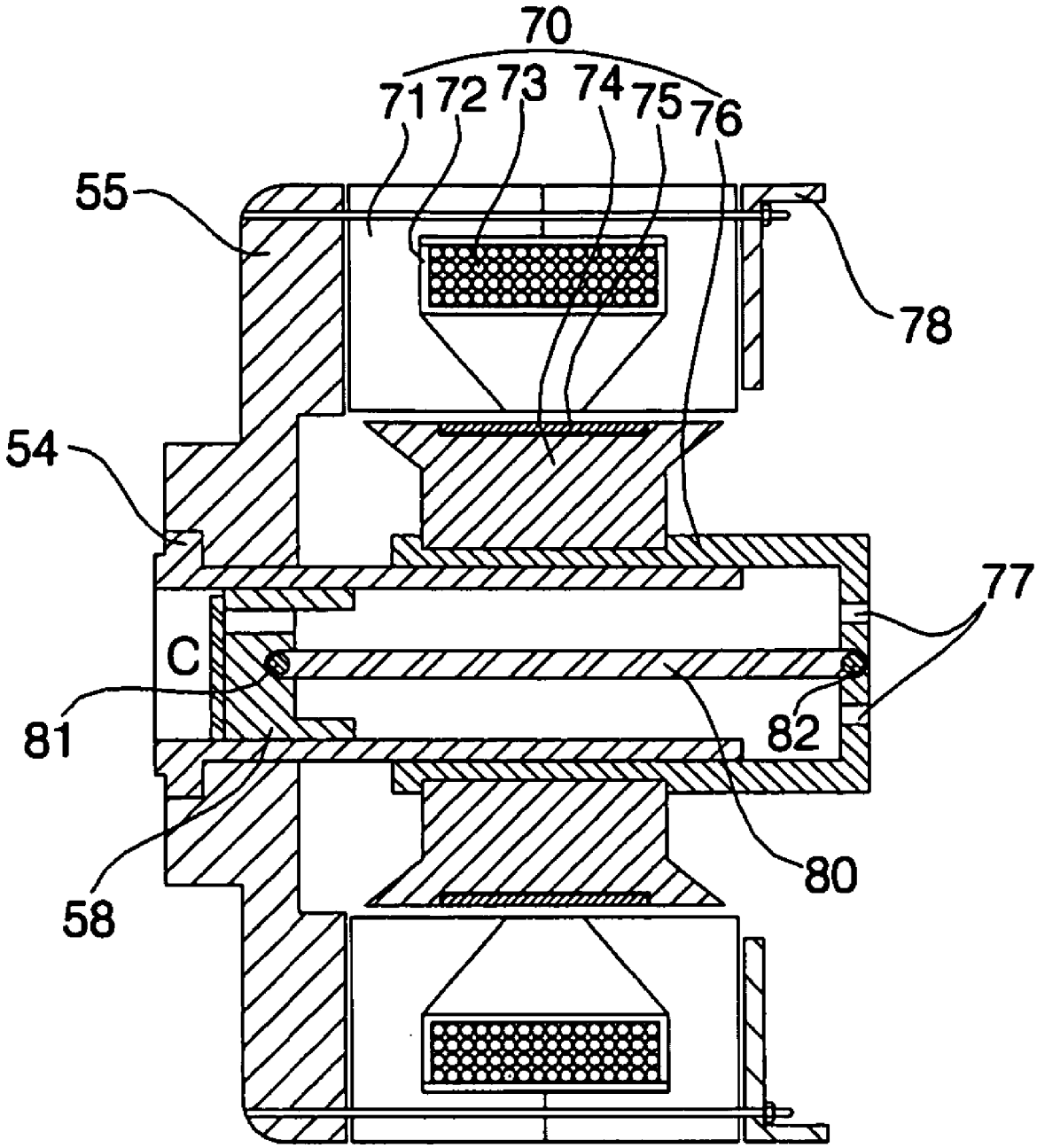
FIG. 3 is an enlarged cross-sectional view illustrating a linear motor of the linear compressor according to the first embodiment of the present invention.

FIG. 2 is a longitudinal cross-sectional view of a linear compressor according to a first embodiment of the present invention. FIG. 3 is an enlarged cross-sectional view illustrating a linear motor of the linear compressor according to the first embodiment of the present invention.

As shown in FIG. 2, the linear compressor according to the first embodiment of the present embodiment includes a shell 50, and a linear compression unit 51 mounted in the shell 50 and adapted to compress fluid.

A suction pipe 52 projects through the side of the shell 50 to introduce fluid into the shell 50, and a loop pipe 53 also projects through the side of the shell 50 to discharge the fluid from the shell 50.

The linear compression unit 51 includes a cylinder block 55 centrally provided with a cylinder 54, a rear cover 57 having a fluid suction port 56 that is positioned to face the suction pipe 52, a piston 58 inserted in the cylinder 54 to linearly reciprocate inside the cylinder 54, a linear motor 70 adapted to generate a driving force for linearly reciprocating the piston 58 inside the cylinder 54, and a discharge valve assembly 60 mounted at a front side of the cylinder 54 to discharge compressed fluid.

The discharge valve assembly 60 includes a discharge valve 61 to open or close a front end of the cylinder 54, an inner discharge cover 63 having a discharge spring 62 to elastically support the discharge valve 61, an outer discharge cover 64 configured to define a fluid channel between an inner circumference thereof and the inner discharge cover 63, and the loop pipe 53 mounted to the outer discharge cover 64.

The interior space of the cylinder 54 is divided into a fluid suction channel 59 and a fluid compression chamber C by the piston 58.

That is, the compression chamber C is positioned at a front side of the piston 58 within the cylinder 54, i.e., between a front surface of the piston 58 and the discharge valve assembly 60, and the fluid suction channel 59 is provided at a rear side of the piston 58 within the cylinder 54.

The piston 58 is formed with a suction port 65 to guide the fluid, introduced via the fluid suction channel 59, into the compression chamber C. A suction valve 66 is mounted at the front surface of the piston 58 to open or close the suction port 65.

As shown in FIGS. 2 and 3, the linear motor 70 includes an outer core 71, a bobbin 72 mounted in the outer core 71, a coil 73 wound around the bobbin 72, an inner core 74 spaced apart from the outer core 71 to define a predetermined gap therebetween, a magnet 75 mounted in the inner core 74, and a core frame 76 configured to support the inner core 74 mounted thereon.

The magnet 75 is mounted in an outer circumference of the inner core 74 to simultaneously move along with the inner core 74.

The core frame 76 has a cylindrical shape having an open front surface, and is slidably mounted on an outer circumference of the cylinder 54.

That is, an inner circumference of the core frame 76 comes into close contact with the outer circumference of the cylinder 54.

A muffler 67 is mounted between a rear surface of the core frame 76 and the fluid suction port 56 of the rear cover 57 to attenuate or reduce suction noise of fluid.

The core frame 76 is formed, at the rear surface thereof, with a plurality of first suction ports 77 to introduce the fluid, passed through the muffler 67, into the cylinder 54. The plurality of first suction ports 77 are formed at the rear surface of the core frame 76 to be spaced apart from one another by a predetermined distance in a circumferential direction.

The linear compressor according to the present invention further includes a connector or connecting member between the piston 58 and the core frame 76. The connector or connecting member is a connecting rod 80 to connect the piston 58 to the core frame 76.

Opposite ends of the connecting rod 80 are rotatably coupled to the piston 58 and the core frame 76, respectively.

In this case, the opposite ends of the connecting rod 80 may be coupled to the piston 58 and the core frame 76 by universal joints or may be hingedly coupled thereto by hinge pins. The following description of the present embodiment is limited to hinge coupling using the hinge pins.

That is, as shown in FIG. 3, one end of the connecting rod 80 is hingedly coupled to the piston 58 by a first hinge pin 81, and the other end of the connecting rod 80 is hingedly coupled to the core frame 76 by a second hinge pin 82.

Further, the cylinder block 55 is located at a front side of the outer core 71, and a core cover 78 is located at a rear side of the outer core 71 to keep the outer core 71 in a fixed condition.

Both the cylinder block 55 and the core cover 78 are axially fastened to the outer core 71 by suitable fastening devices such as, for example, bolts 83 and nuts 84 to apply an axial compression force to the outer core 71.

In the linear compressor of the present invention, also, main springs are mounted to elastically support linear reciprocating movements of the piston 58 and the core frame 76. The main springs include a first main spring 85 mounted between a spring support 79 that is affixed to the rear surface of the core frame 76 and the rear cover 57, and a second main spring 86 mounted between the core cover 78 and the spring support 79.

The spring support 79 is formed with second suction ports 87 to communicate with the first suction ports 77 of the core frame 76.

Now, the operation of the linear compressor according to the present invention configured as stated above will be explained.

First, if a voltage is applied to the coil 73, a magnetic field is generated around the coil 73 to interact with the magnet 75, thereby allowing the magnet 75 to linearly reciprocate.

Upon linear reciprocating movement of the magnet 75, the inner core 74 and the core frame 76 are moved simultaneously with the magnet 75.

Thereby, as linear reciprocating movement of the core frame 76 is transmitted to the piston 58 via the connecting rod 80, the piston 58 is linearly reciprocated inside the cylinder 54.

That is, when the magnet 75 is retracted, i.e. is moved rearward, the inner core 74 and the core frame 76 are pushed rearward to thereby pull the connecting rod 80. As a result, the piston 58 is also moved rearward by the connecting rod 80.

Upon the rearward movement of the piston 58, the suction valve 66 opens the suction port 65 due to a pressure difference between the compression chamber C and the suction channel 59, thereby allowing the fluid inside the suction channel 59 to be introduced into the compression chamber C via the suction port 65.

Additionally, when the magnet 75 is advanced, i.e. is moved forward, the inner core 74 and the core frame 76 are pushed forward to thereby push the connecting rod 80. As a result, the piston 58 is also moved forward by the connecting rod 80.

Upon the forward movement of the piston 58, the suction valve 66 closes the suction port 65 under the influence of the fluid introduced into the compression chamber C and an elastic force thereof, thereby allowing the fluid inside the compression chamber C to be compressed by the piston 58.

The fluid that is compressed by the piston 58 is discharged to the outside of the shell 50 via the discharge valve assembly 60 and the loop pipe 53.

In this case, the fluid inside the shell 50 is introduced into the suction channel 59 under the influence of a negative pressure produced in the suction channel 59 by passing through the fluid suction port 56 of the rear cover 57, the muffler 67, and the first and second suction ports 77 and 87 in this sequence.

Therefore, in the linear compressor of the present invention, the core frame 76 achieves a sufficient force to support the weight of the inner core 74 mounted thereon because the core frame 76 comes into close contact with the outer circumference of the cylinder 54, resulting in improved rigidity and reliability of the compressor.

Further, since the gap is defined only between the magnet 75 and the outer core 71, tolerance control thereof is easy.

Furthermore, as a result of hingedly coupling the connecting rod 80 to both the core frame 76 and the piston 58, a force, which is applied from the linear motor 70 in a direction perpendicular to the reciprocating movement direction of the piston 58, is absorbed by hinge coupling portions without being transmitted to the piston 58. This is effective to prevent abrasion of the piston 58 and the cylinder 54.

Figure 4:
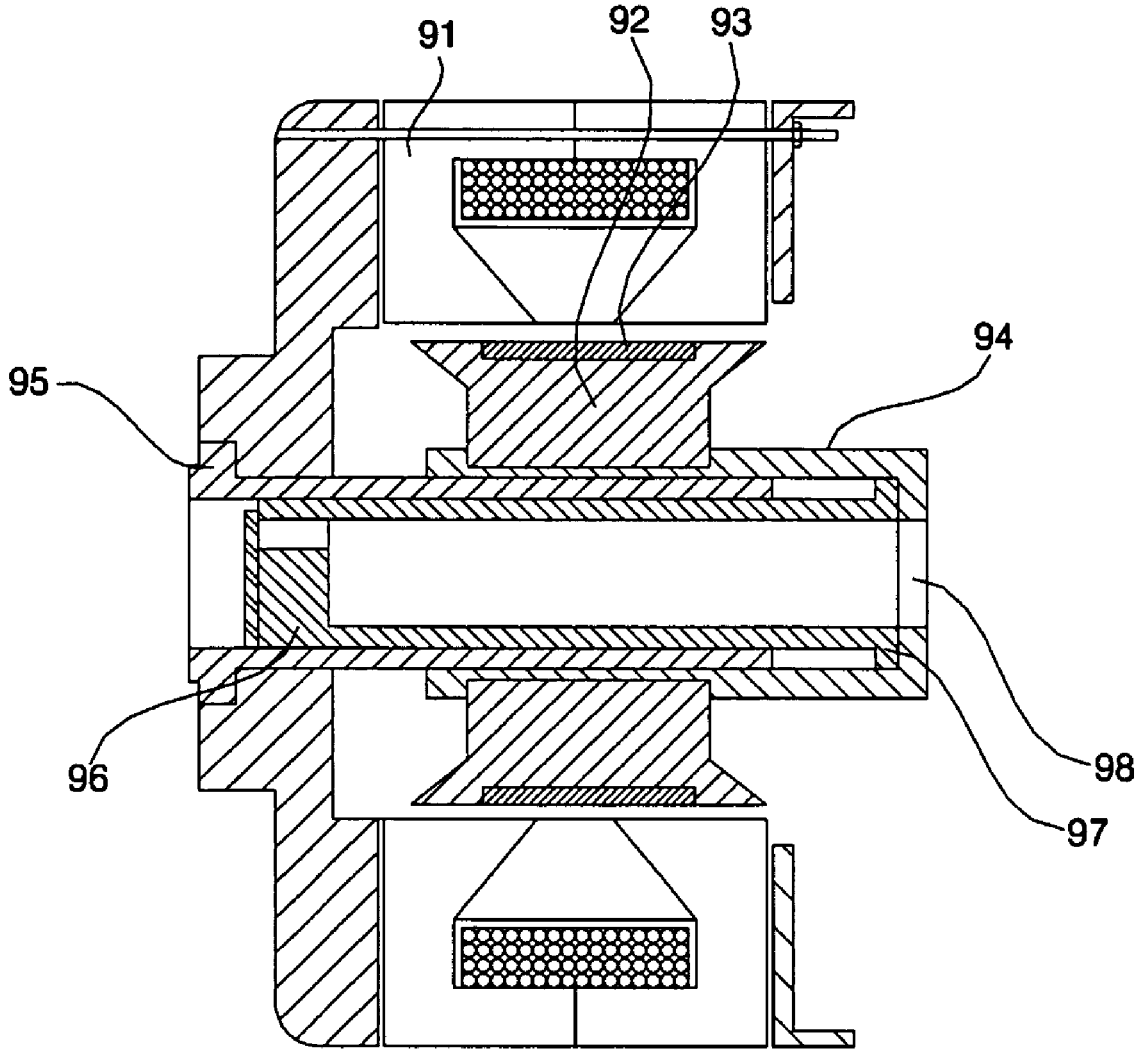
FIG. 4 is an enlarged cross-sectional view illustrating a linear motor of a linear compressor according to a second embodiment of the present invention.

FIG. 4 is an enlarged sectional view illustrating a linear motor of a linear compressor according to a second embodiment of the present invention.

As shown in FIG. 4, the linear compressor according to the present embodiment includes an outer core 91, an inner core 92 spaced apart from the outer core 91 to define a gap therebetween, a magnet 93 mounted in an outer circumference of the inner core 92, a core frame 94 to support the inner core 92 mounted thereon, a cylinder 95 mounted to come into close contact with an inner circumference of the core frame 94, and a piston 96 inserted in the cylinder 95 to linearly reciprocate inside the cylinder 95.

The present embodiment is identical in configuration and operation to the first embodiment except that the piston 96 is directly coupled to the core frame 94 without using a separate connector, and thus, a detailed description thereof will be omitted.

The piston 96 has a flange portion 97 formed at a rear end thereof to be coupled to the core frame 94. The flange portion 97 may be fixed to the core frame 94 by a suitable device such as, for example, fastening members or an adhesive.

The core frame 94 has a cylindrical shape having an open front surface. At a rear surface of the core frame 94 is formed a fluid suction port 98.

With the linear compressor according to the second embodiment of the present invention as stated above, the core frame 94 achieves a sufficient force to support the weight of the inner core 92, and the coupling structure between the piston 96 and the core frame 94 is simplified.

As is apparent from the above description, the present invention provides a linear compressor in which an inner core is integrally mounted with a magnet to linearly reciprocate simultaneously and is also mounted on a core frame that comes into close contact with an outer circumference of a cylinder. This configuration provides the core frame with a sufficient force to support the inner core, resulting in improved rigidity and reliability of the compressor.

Further, according to the present invention, since the core frame is connected to a piston by interposing a connecting rod, and opposite ends of the connecting rod are hingedly coupled to both the core frame and the piston, it is possible to prevent a force generated from a linear motor from being directly transmitted to the piston, thereby eliminating the risk of abrasion of the piston and cylinder.

Although the invention has been described with reference to exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. A linear compressor comprising:

an outer core;

an inner core spaced apart from said outer core to define a gap therebetween;

a magnet spaced apart from the outer core and provided between the inner core and the outer core;

a core frame;

a cylinder provided to come into contact at an outer circumference thereof with an inner circumference of said core frame;

a piston provided to reciprocate inside said cylinder, wherein the magnet is fixedly mounted to the inner core, the inner core is fixedly mounted to the core frame such that the magnet and the inner core are reciprocated linearly with the core frame, and the piston is connected to the core frame by a connecting rod such that the piston is reciprocated linearly with the core frame.

2. The compressor as set forth in claim 1, wherein said connecting member is a connecting rod to connect said piston to said core frame.

3. The compressor as set forth in claim 2, wherein opposite ends of said connecting rod are rotatably coupled to said piston and said core frame, respectively.

4. The compressor as set forth in claim 3, wherein said opposite ends of said connecting rod are coupled to said piston and said core frame, respectively, by universal joints.

5. The compressor as set forth in claim 3, wherein said opposite ends of said connecting rod are hingedly coupled to said piston and said core frame, respectively, by hinge pins.

6. The compressor as set forth in claim 3, wherein said core frame has a cylindrical shape having an open front surface and is slidably provided on said outer circumference of said cylinder.

7. The compressor as set forth in claim 6, wherein said core frame includes a plurality of fluid suction ports formed at a rear surface thereof.

8. The compressor as set forth in claim 7, wherein a plurality of said fluid suction ports are arranged at said rear surface of said core frame to be spaced apart from one another by a predetermined distance in a circumferential direction.

9. The compressor as set forth in claim 7, wherein a spring support is coupled to said core frame to cooperate with said core frame.

10. The compressor as set forth in claim 9, wherein a plurality of main springs are mounted to said spring support to provide an elastic force during a sliding movement of said core frame.

11. The compressor as set forth in claim 10, wherein:

an interior space of said cylinder is divided into a fluid suction channel and a compression chamber by said piston; and said piston is formed with suction ports to guide fluid, introduced via said suction channel, into said compression chamber.

12. The compressor as set forth in claim 11, further comprising:

a muffler mounted at said rear surface of said core frame to reduce suction noise of the fluid.

13. The compressor as set forth in claim 12, said linear compressor further comprising:

a bobbin mounted in said outer core; and a coil wound around said bobbin.

14. A linear compressor comprising:

an outer core;

an inner core spaced apart from said outer core to define a gap therebetween;

a magnet mounted at an outer circumference of said inner core;

a core frame supporting said inner core mounted thereon, the core frame having an inner circumference;

a cylinder having an outer circumference; and a piston provided to reciprocate inside said cylinder and connected to said core frame, wherein the inner circumference of said core frame comes into contact with the outer circumference of said cylinder, the core frame being formed in a cylindrical shape having an open front surface such that the core frame is slidably inserted on said outer circumference of said cylinder.

15. The compressor as set forth in claim 14, wherein said core frame has fluid suction ports formed at a rear surface thereof.

16. The compressor as set forth in claim 15, wherein a plurality of said fluid suction ports are arranged at said rear surface of said core frame to be spaced apart from one another by a predetermined distance in a circumferential direction.

17. The compressor as set forth in claim 14, wherein a spring support is coupled to said core frame to cooperate with said core frame.

18. The compressor as set forth in claim 17, wherein a plurality of main springs are mounted to said spring support to provide an elastic force during a sliding movement of said core frame.

19. The compressor as set forth in claim 18, said linear compressor further comprising: a muffler mounted at said rear surface of said core frame to reduce suction noise of the fluid.

20. The compressor as set forth in claim 14, wherein the piston has a flange portion formed at a rear end thereof to be coupled to the core frame.

* * * * *